US010436030B2

(12) United States Patent
Walkenhorst et al.

(10) Patent No.: US 10,436,030 B2
(45) Date of Patent: Oct. 8, 2019

(54) STEAM TURBINE AND METHOD FOR OPERATING A STEAM TURBINE

(71) Applicant: Siemens Aktiengesellschaft, Munich (DE)

(72) Inventors: Jan Walkenhorst, Mülheim an der Ruhr (DE); Uwe Zander, Mülheim an der Ruhr (DE); Armin de Lazzer, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 318 days.

(21) Appl. No.: 15/503,552

(22) PCT Filed: Aug. 19, 2015

(86) PCT No.: PCT/EP2015/068991
§ 371 (c)(1),
(2) Date: Feb. 13, 2017

(87) PCT Pub. No.: WO2016/026880
PCT Pub. Date: Feb. 25, 2016

(65) Prior Publication Data

US 2017/0234131 A1 Aug. 17, 2017

(30) Foreign Application Priority Data

Aug. 20, 2014 (EP) ..... 14181559

(51) Int. Cl.
*F01D 3/02* (2006.01)
*F01D 25/12* (2006.01)
(Continued)

(52) U.S. Cl.
CPC ..... *F01D 3/02* (2013.01); *F01D 3/04* (2013.01); *F01D 25/12* (2013.01); *F01D 25/26* (2013.01);
(Continued)

(58) Field of Classification Search
CPC . F01D 11/08; F01D 25/26; F01D 9/06; F01D 25/12; F01D 25/24; F01D 11/04;
(Continued)

(56) References Cited

U.S. PATENT DOCUMENTS 4,661,043 A 4/1987 Groenendaal et al.
6,443,690 B1 9/2002 Zabrecky et al.
(Continued)

FOREIGN PATENT DOCUMENTS

CN 86106925 A 5/1987
CN 101052782 A 10/2007
(Continued)

OTHER PUBLICATIONS

CN Office Action dated Aug. 28, 2017, for CN Patent Application No. 201580044345.X.
(Continued)

*Primary Examiner* — Dominik L Plakkoottam
(74) *Attorney, Agent, or Firm* — Beusse Wolter Sanks & Maire

(57) ABSTRACT

A steam turbine having a cooling option, in which steam is taken from the flow channel, the steam cooling the thrust-compensating intermediate floor, being mixed with a small amount of live steam and being returned to the flow channel. A method cools the steam turbine, wherein steam is extracted from the high-pressure region and is fed to a space between the thrust-compensating partition wall and inner casing, wherein steam from the space between the thrust-compensating partition wall and the inner casing is fed via a first cross feedback passage to the high-pressure region.

14 Claims, 2 Drawing Sheets

(51) Int. Cl.
*F01D 3/04* (2006.01)
*F01D 25/26* (2006.01)

(52) U.S. Cl.
CPC ..... *F05D 2220/31* (2013.01); *F05D 2240/56* (2013.01); *F05D 2260/2322* (2013.01)

(58) Field of Classification Search
CPC ... F01K 7/22; F01K 7/16; F01K 23/16; F01K 7/38; F05D 2220/31; F05D 2230/00; F05D 2260/201; F05D 2260/2322; F05D 2240/56; F05D 2260/205
USPC ..... 415/100, 104, 105, 106, 107, 140, 58.7, 415/59.1, 144, 23, 108, 93, 1
See application file for complete search history.

(56) References Cited

U.S. PATENT DOCUMENTS

| | | | | |
|---|---|---|---|---|
| 6,705,086 | B1 | 3/2004 | Retzlaff et al. | |
| 6,957,945 | B2 | 10/2005 | Tong et al. | |
| 2008/0003095 | A1 | 1/2008 | Dewhurst | |
| 2008/0213085 | A1* | 9/2008 | Deidewig | F01D 3/04 415/104 |
| 2009/0185895 | A1 | 7/2009 | Wieghardt | |
| 2012/0023945 | A1* | 2/2012 | Ishiguro | F01D 5/082 60/646 |
| 2012/0043728 | A1 | 2/2012 | Zeng et al. | |
| 2014/0199161 | A1 | 7/2014 | Holder et al. | |
| 2015/0260055 | A1* | 9/2015 | Ishiguro | F01D 5/082 165/51 |

FOREIGN PATENT DOCUMENTS

| | | | |
|---|---|---|---|
| CN | 101096916 | A | 1/2008 |
| EP | 2402565 | A1 | 1/2012 |
| EP | 2554789 | A1 | 2/2013 |
| EP | 2565377 | A1 | 3/2013 |
| JP | H11141302 | A | 5/1999 |
| JP | 2006046088 | A | 2/2006 |
| JP | 2009513866 | A | 4/2009 |
| JP | 2012041923 | A | 3/2012 |
| WO | 2010097983 | A1 | 8/2012 |

OTHER PUBLICATIONS

International Search Report dated Oct. 19, 2015, for PCT/EP2014/068991.
EP Search Report dated Nov. 4, 2014, for EP patent application No. 14181559.7.
JP Office Action dated Nov. 6, 2017, for JP patent application No. 2017509668.

* cited by examiner

STEAM TURBINE AND METHOD FOR OPERATING A STEAM TURBINE

CROSS REFERENCE TO RELATED APPLICATIONS

This application is the US National Stage of International Application No. PCT/EP2015/068991 filed Aug. 19, 2015, and claims the benefit thereof. The International Application claims the benefit of European Application No. EP14181559 filed Aug. 20, 2014. All of the applications are incorporated by reference herein in their entirety.

FIELD OF INVENTION

The invention relates to a steam turbine comprising an inner casing and an outer casing and also a rotor which is arranged in a rotatably supported manner inside the inner casing, wherein the outer casing is arranged around the inner casing, wherein the rotor has a high-pressure region which is arranged along a first flow direction and an intermediate-pressure region which is arranged along a second flow direction.

Furthermore, the invention relates to a method for cooling a steam turbine, wherein the steam turbine has a high-pressure region and an intermediate-pressure region, wherein a rotor is arranged between the high-pressure region and the intermediate-pressure region and has a thrust-compensating partition wall.

BACKGROUND OF INVENTION

Any turbine or turbine section which is exposed to a throughflow of a working medium in the form of steam is understood by a steam turbine in the sense of the present application. In contrast to this, gas turbines are exposed to a throughflow of gas and/or air as working medium which, however, is subject to totally different temperature and pressure conditions than steam in the case of a steam turbine. Unlike gas turbines, in steam turbines the working medium which flows into a turbine section at the highest temperature has at the same time the highest pressure, for example. An open cooling system, which is open to the flow passage, can be realized in gas turbines even without external feed of cooling medium to turbine sections. For a steam turbine, an external feed of cooling medium ought to be provided. Gas turbines which relate to the prior art cannot even be consulted for assessment of the present application subject matter for this reason.

A steam turbine customarily comprises a rotatably supported rotor which is fitted with blades and arranged inside a casing or casing shell. When the interior space of the flow passage which is formed by the casing shell is exposed to a throughflow of heated and pressurized steam, the rotor, via the blades, is made to rotate by means of the steam. The blades of the rotor are also referred to as rotor blades. Customarily suspended on the inner casing, moreover, are stationary stator blades which along an axial extension of the body engage in the interspaces of the rotor blades. A stator blade is customarily retained at a first point along an inner side of the steam turbine casing. In this case, it is customarily part of a stator blade row which comprises a number of stator blades which are arranged along an inside circumference on an inner side of the steam turbine casing. In this case, each stator blade points radially inward by its blade airfoil. A stator blade row on the mentioned first point along the axial extension is also referred to as a stator blade cascade or ring. Customarily, a number of stator blade rows are connected in series. A further second blading is correspondingly retained along the inner side of the steam turbine casing at a second point along the axial extent downstream of the first point. A pair comprising a stator blade row and a rotor blade row is also referred to as a blading stage.

The casing shell of such a steam turbine can be formed from a number of casing segments. The stationary casing component of a steam turbine or of a turbine section which along the longitudinal direction of the steam turbine has an interior space in the form of a flow passage which is provided for the throughflow by the working medium in the form of steam is especially to be understood by the casing shell of the steam turbine. This can be an inner casing and/or a stator blade carrier, depending on steam turbine type. However, provision can also be made for a turbine casing which does not have an inner casing or stator blade carrier.

For efficiency reasons, the design of such a steam turbine may be desirable for so-called "high steam parameters", therefore especially high steam pressures and/or high steam temperatures. However, for material engineering reasons a temperature increase is especially not possible without limitation. In order to also enable a reliable operation of the steam turbine at particularly high temperatures in this case a cooling of individual parts or components may therefore be desirable. Without efficient cooling, significantly more expensive materials (e.g. nickel-based alloys) would be required in the case of increasing temperatures.

In the case of the previously known cooling methods, especially for a steam turbine body in the form of a steam turbine casing or of a rotor, a differentiation is to be made between an active cooling system and a passive cooling system. In the case of an active cooling system, cooling by means of a cooling medium which is fed separately to the steam turbine body, i.e. in addition to the working medium, is put into effect. On the other hand, passive cooling is carried out purely by a suitable conduction or use of the working medium. Up to now, steam turbine bodies have been preferably passively cooled.

All cooling methods which are known to date for a steam turbine casing, providing they chiefly concern active cooling methods, therefore provide at best a directed inflow to a separate turbine section which is to be cooled and are restricted to the inflow region of the working medium, at any event including the first stator blade ring. In the case of loading of conventional steam turbines with higher steam parameters, this can lead to an increased thermal loading which acts upon the entire turbine and which could be only inadequately reduced by means of conventional cooling of the casing which is described above.

Embodiments of steam turbines are known which in addition to a first flow passage have a second flow passage, wherein both the first flow passage and the second flow passage are arranged inside a casing. Such constructional forms are also referred to as compact turbines. Embodiments are known in which the first flow passage is designed for high-pressure blading and the second flow passage is designed for intermediate-pressure blading. The flow directions of the first flow passage and of the second flow passage point in this case in opposite directions in order to minimize the thrust compensation as a result. In the main, such constructional forms comprise a rotor which is designed with a high-pressure region and an intermediate-pressure region and is rotatably supported inside an inner casing, wherein an outer casing is arranged around the inner casing. The high-pressure region is designed for live steam temperatures. After the live steam has flowed through the high-pressure region, the steam flows to a reheater and is brought to a higher temperature there, and then flows through the intermediate-pressure region of the steam turbine.

The limits of use of such rotors are defined by thermally highly stressed regions. With temperatures becoming greater, the essential strength characteristic value decreases superproportionally. As a result, maximum permissible shaft diameters ensue which especially lead to limitations in 60 Hertz applications, which concerns the rotor-dynamic degree of slenderness of the rotor. Therefore, upon reaching limits of use, in the case of a monoblock rotor a change is usually made to the next best material which withstands the thermal demands or a rotor is of a welded construction, wherein two materials are designed in each case for the thermal stresses.

It would be desirable to have an effective cooling system in a steam turbine component, especially for a steam turbine operated at high temperature.

SUMMARY OF INVENTION

The invention is introduced at this point, an object of which is to specify a steam turbine and a method for its production, in which cases the steam turbine is particularly effectively cooled even in the high-pressure region.

The object is achieved by means of a steam turbine and by means of a method claimed herein.

It is an idea of the invention to design a passive cooling system. The invention is oriented in this case on a steam turbine in the aforesaid compact type of construction. This means that inside a common outer casing the steam turbine has a high-pressure region and an intermediate-pressure region. The high-pressure region is designed for live steam temperatures. The live steam temperatures lie in this case between 530° C. and 720° C. at a pressure of 80-350 bar. The intermediate-pressure region is for temperatures in the inlet region of 530° C.-750° C. at a pressure of 30-120 bar.

In a steam power plant, the difference between high-pressure blading and intermediate-pressure blading is as follows: Live steam first of all flows through a turbine section which is designed for the live steam. After the live steam has flowed through the high-pressure region this flows to a reheater and is heated up there to the intermediate-pressure inlet temperatures and then flows through the intermediate-pressure region. After flowing through the intermediate-pressure region, the steam flows to a low-pressure region and has lower steam parameters there.

It is now an idea of the invention to now design the steam turbine in such a way that a thrust-compensating partition wall can be passively cooled. To this end, steam is tapped from the high-pressure flow passage at a suitable point from the flow passage and guided to the thrust-compensating partition wall at one point. This steam can then diffuse in the region between the thrust-compensating partition wall and the inner casing. It is a further idea of the invention that the aforesaid steam can mix with a part of the live steam which via a cross feedback passage can then again be guided to the first flow passage.

Advantageous developments are disclosed in the dependent claims.

In a first advantageous development, the first high-pressure blading stage is arranged upstream of the second high-pressure blading stage as seen along the first flow direction.

This means that the steam which is extracted from the first high-pressure blading stage has higher steam parameters than the steam which is extracted from the second high-pressure blading stage. As a result, target-oriented suitable steam can be extracted from the high-pressure blading region.

In a further advantageous development, the first thrust-compensating piston partition wall space is arranged upstream of the second thrust-compensating partition wall space as seen along the first flow direction. Since the thermal load of the thrust-compensating partition wall is variable, the invention provides that a better cooling capability is possible if the first thrust-compensating partition wall space is arranged upstream of the second thrust-compensating partition wall space as seen along the first flow direction.

In a further advantageous development, between the inner casing and the thrust-compensating partition wall a first brush seal is arranged upstream of the second thrust-compensating partition wall space along the second flow direction and a second brush seal is arranged downstream of the first thrust-compensating partition wall space along the second flow direction.

In a particular advantageous development, the first cross feedback passage is designed with feedback pipes. As a result, the thermal compensation can be optimized.

In a further advantageous development, the connection is formed by means of connecting pipes and this similarly leads to an advantageous temperature compensation.

In a particular advantageous development, the steam turbine is designed with a second cross feedback passage which, as communicating pipe, is arranged between a third thrust-compensating partition wall space, which is formed between the thrust-compensating partition wall and the inner casing, and a third high-pressure blading stage.

Consequently, additional steam in the space between the partition wall and the inner casing can be used for cooling options and for work expansion.

The third high-pressure blading stage is advantageously arranged downstream of the second high-pressure blading stage as seen in the first flow direction.

In this way, by means of the invention the thrust-compensating partition wall can be optimally cooled.

As a result, a widening of the mechanical limits of use of the rotor is possible in the shaft interior due to temperature reduction. Furthermore, an assurance of adequate cooling of the thrust-compensating partition wall is possible with the potential use of brush seals. Also, by means of the arrangement according to the invention the thermally critically loaded region of the components is cooled by means of a passive system.

The characteristics, features and advantages of this invention which are described above, and also the way in which these are achieved, become more clearly and more plainly comprehensible in conjunction with the following description of the exemplary embodiments which are explained in more detail in conjunction with the drawings.

Exemplary embodiments of the invention are described below with reference to the drawing. This drawing is not to definitively represent the exemplary embodiments, rather the drawing, where useful for the explanation, is implemented in schematized and/or slightly distorted form. With regard to supplements of the teachings which are directly recognizable in the drawing, reference is made to the applicable prior art.

DETAILED DESCRIPTION OF INVENTION

Figure 1:
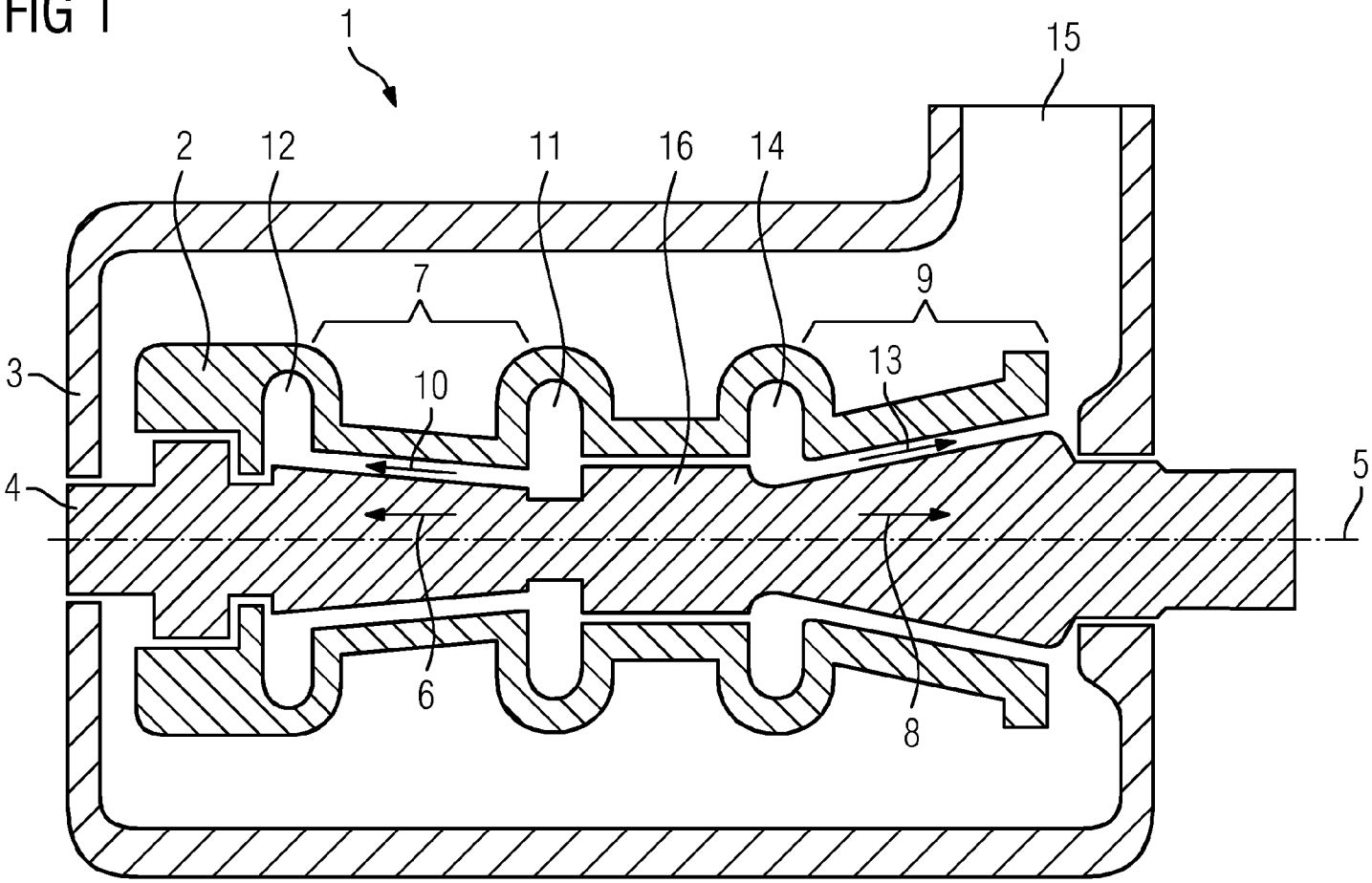
FIG. 1 shows a schematic cross-sectional view of a steam turbine.

FIG. 1 shows a steam turbine 1 comprising an inner casing 2 and an outer casing 3 and also a rotor 4. The rotor 4 is arranged in a rotatably supported manner inside the inner casing 2. The bearing arrangement is not shown in more detail. The outer casing 3 is arranged around the inner casing 2. The rotor 4 is designed in the main rotationally symmetrically around the rotational axis 5. Along a first flow direction 6, which extends generally parallel to the rotational axis 5, the rotor 4 has a high-pressure region 7. Arranged opposite to the first flow direction 6, the rotor 4 has an intermediate-pressure region 9 which is arranged along the second flow direction 8.

In the high-pressure region 7, the inner casing 2 has a plurality of high-pressure stator blades (not shown) which are arranged on the circumference around the rotational axis 5. The high-pressure stator blades are arranged in such a way that a high-pressure flow passage 10, having a plurality of high-pressure blading stages (not shown) which in each case have a row of high-pressure rotor blades and a row of high-pressure stator blades, is formed along the first flow direction 6.

Via a first high-pressure inflow region 11, live steam flows into the steam turbine 1 and then flows through the high-pressure flow passage 10. The steam expands in the high-pressure flow passage 10, wherein the temperature drops. The thermal energy of the steam is converted into rotational energy of the rotor 4. After the steam has flown through the high-pressure flow passage 10, it flows onward out of the steam turbine 1 from a high-pressure outflow region 12 to a reheater (not shown in more detail). In the reheater, the cooled steam is again brought up to a high temperature which is comparable to the live steam temperature in the high-pressure inflow region. However, the pressure in the inflow region 11 is appreciably lower.

In the intermediate-pressure region 9, the inner casing 2 has a plurality of intermediate-pressure stator blades (not shown) which are arranged in such a way that an intermediate-pressure flow passage 13, having a plurality of intermediate-pressure blading stages (not shown) which in each case have a row of intermediate-pressure rotor blades and a row of intermediate-pressure stator blades, is formed along the second flow direction 8.

Downstream of the reheater, the steam flows via the intermediate-pressure inflow region 14 through the intermediate-pressure flow passage 13. The thermal energy of the steam is converted into rotational energy of the rotor 4. Downstream of the intermediate-pressure flow passage 13, the steam flows out of the turbine 1 via an outlet 15. The steam is then directed further to a low-pressure turbine section (not shown) or to a process as process steam. The rotor 4 has a thrust-compensating partition wall 16 between the high-pressure flow passage 10 and the intermediate-pressure flow passage 13.

This thrust-compensating partition wall 16 has a larger diameter than the rotor 4.

The live steam temperature lies at 530° C.-720° C. at a pressure of 80 bar-350 bar. The intermediate-pressure temperature lies at 530° C.-750° C. at a pressure of 30 bar-120 bar.

Figure 2:
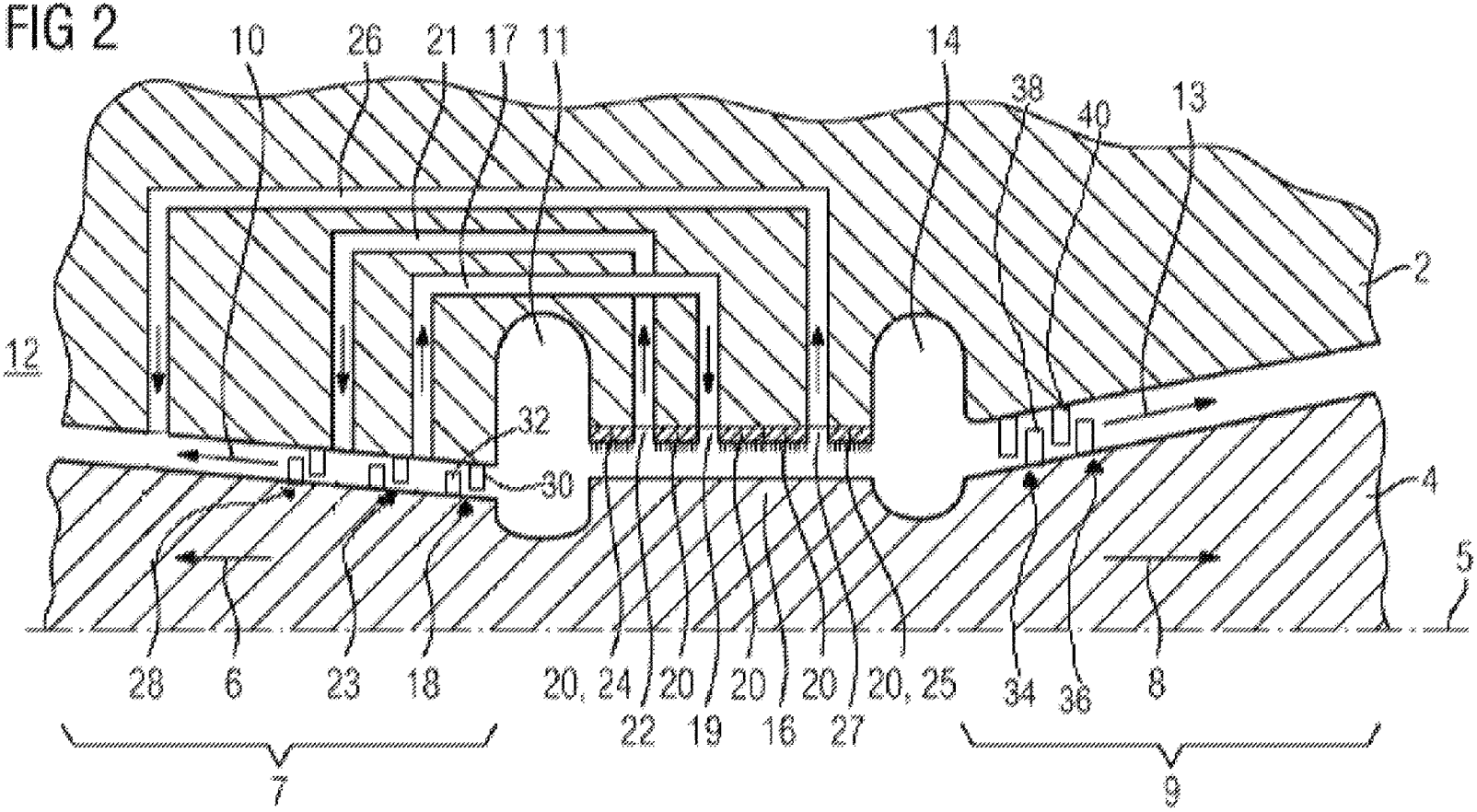
FIG. 2 shows a detail of the steam turbine shown in FIG. 1 with the arrangement according to the invention.

FIG. 2 shows a detail of the steam turbine 1 from FIG. 1, wherein further features according to the invention are shown in FIG. 2. The inner casing 2 has a connection 17 which, as communicating pipe, is arranged between the high-pressure flow passage 10, downstream of a first high-pressure blading stage 18, and a first thrust-compensating partition wall space 19, wherein the thrust-compensating partition wall space 19 is arranged between the thrust-compensating partition wall 16 and the inner casing 2. The inner casing 2 has a plurality of segments 20 in the region of the thrust-compensating partition wall 16. The segments 20 in each case have a labyrinth seal (not shown). The first high-pressure blading stage 18 includes a plurality of high pressure stator blades 30 and a plurality of high pressure rotor blades 32. The turbine 1 also includes intermediate-pressure blading stages 34, 36 which in each case have a row of intermediate pressure rotor blades 38 and a row of intermediate pressure stator blades 40.

The inner casing 2 furthermore has a first cross feedback passage 21 which, as a communicating pipe, is arranged between a second thrust-compensating partition wall space 22 (which is arranged between the thrust-compensating partition wall 16 and the inner casing 2) and a second high-pressure blading stage 23.

The first high-pressure blading stage 18 is arranged upstream of the second high-pressure blading stage 23 as seen along the first flow direction 6.

The first thrust-compensating partition wall space 19 is arranged upstream of the second thrust-compensating partition wall space 22 as seen along the first flow direction 6.

Between the inner casing 2 and the thrust-compensating partition wall 16 a first brush seal 24 is arranged upstream of the second thrust-compensating partition wall space 22 along the second flow direction 8.

A second brush seal 25 is arranged downstream of the first thrust-compensating partition wall space 19 along the second flow direction 8.

The first cross feedback passage 21 can be formed by pipes (not shown) in alternative embodiments. In the exemplary embodiment shown in FIG. 2 the cross feedback passage 21 is arranged in the inner casing 2.

The connection 17 is formed in the inner casing 2 in the exemplary embodiment selected in FIG. 2 and in alternative embodiments the connection 17 can be formed by connecting pipes.

The steam turbine 1 has a second cross feedback passage 26 which, as communicating pipe, is formed between a third thrust-compensating partition wall space 27, which is arranged between the thrust-compensating partition wall 16 and the inner casing 2, and a high-pressure inflow space, which is arranged downstream of a third high-pressure blading stage 28, in the high-pressure flow passage 10.

The third high-pressure blading stage 28 is arranged downstream of the second high-pressure blading stage 23 as seen in the first flow direction 6. The cross feedback passage 26 can be formed in the inner casing 20. In alternative embodiments, the third cross feedback passage 26 can be formed as a pipe.

Although the invention has been described and fully illustrated in detail by means of the preferred exemplary embodiment, the invention is therefore not limited by the disclosed examples and other variations can be derived by the person skilled in the art without departing from the scope of protection of the patent.

The invention claimed is:

1. A steam turbine comprising:

an inner casing and an outer casing and also a rotor which is arranged in a rotatably supported manner inside the inner casing, wherein the outer casing is arranged around the inner casing, wherein the rotor has a high-pressure region which is arranged along a first flow direction and an intermediate-pressure region which is arranged along a second flow direction, wherein the inner casing has a plurality of high-pressure stator blades in the high-pressure region, which are arranged in such a way that a high-pressure flow passage, having a plurality of high-pressure blading stages which in each case have a row of high-pressure rotor blades and a row of high-pressure stator blades, is formed along the first flow direction, wherein the inner casing has a plurality of intermediate-pressure stator blades in the intermediate-pressure region, which are arranged in such a way that an intermediate-pressure flow passage, having a plurality of intermediate-pressure blading stages which in each case have a row of intermediate-pressure rotor blades and a row of intermediate-pressure stator blades, is formed along the second flow direction, wherein the rotor has a thrust-compensating partition wall between the high-pressure region and the intermediate-pressure region, wherein the inner casing has a connection which, as a communicating pipe, is formed between the high-pressure flow passage, downstream of a first high-pressure blading stage, and a first thrust-compensating partition wall space, wherein the inner casing has a first cross feedback passage which, as a communicating pipe, is formed between a second thrust-compensating partition wall space, which is arranged between the thrust-compensating partition wall and the inner casing, and a high-pressure inflow space, in the high-pressure flow passage, which is arranged downstream of a second high-pressure blading stage, wherein between the inner casing and the thrust-compensating partition wall a first brush seal is arranged upstream of the second thrust-compensating partition wall space along the second flow direction and a second brush seal is arranged downstream of the first thrust-compensating partition wall space along the second flow direction.

2. The steam turbine as claimed in claim 1, wherein the first high-pressure blading stage is arranged upstream of the second high-pressure blading stage as seen along the first flow direction.

3. The steam turbine as claimed in claim 1, wherein the first thrust-compensating partition wall space is arranged upstream of the second thrust-compensating partition wall space as seen along the first flow direction.

4. The steam turbine as claimed in claim 1, wherein the first cross feedback passage is formed by pipes.

5. The steam turbine as claimed in claim 1, wherein the connection is formed by connecting pipes.

6. A steam turbine comprising:

an inner casing and an outer casing and also a rotor which is arranged in a rotatably supported manner inside the inner casing, wherein the outer casing is arranged around the inner casing, wherein the rotor has a high-pressure region which is arranged along a first flow direction and an intermediate-pressure region which is arranged along a second flow direction, wherein the inner casing has a plurality of high-pressure stator blades in the high-pressure region, which are arranged in such a way that a high-pressure flow passage, having a plurality of high-pressure blading stages which in each case have a row of high-pressure rotor blades and a row of high-pressure stator blades, is formed along the first flow direction, wherein the inner casing has a plurality of intermediate-pressure stator blades in the intermediate-pressure region, which are arranged in such a way that an intermediate-pressure flow passage, having a plurality of intermediate-pressure blading stages which in each case have a row of intermediate-pressure rotor blades and a row of intermediate-pressure stator blades, is formed along the second flow direction, wherein the rotor has a thrust-compensating partition wall between the high-pressure region and the intermediate-pressure region, wherein the inner casing has a connection which, as a communicating pipe, is formed between the high-pressure flow passage, downstream of a first high-pressure blading stage, and a first thrust-compensating partition wall space, wherein the inner casing has a first cross feedback passage which, as a communicating pipe, is formed between a second thrust-compensating partition wall space, which is arranged between the thrust-compensating partition wall and the inner casing, and a high-pressure inflow space, in the high-pressure flow passage, which is arranged downstream of a second high-pressure blading stage, further comprising:

a second cross feedback passage which, as communicating pipe, is formed between a third thrust-compensating partition wall space, which is arranged between the thrust-compensating partition wall and the inner casing, and a high-pressure inflow space, in the high-pressure flow passage, which is arranged downstream of a third high-pressure blading stage.

7. The steam turbine as claimed in claim 6, wherein the third high-pressure blading stage is arranged downstream of the second high-pressure blading stage as seen in the first flow direction.

8. The steam turbine as claimed in claim 6, wherein the first high-pressure blading stage is arranged upstream of the second high-pressure blading stage as seen along the first flow direction.

9. The steam turbine as claimed in claim 6, wherein the first thrust-compensating partition wall space is arranged upstream of the second thrust-compensating partition wall space as seen along the first flow direction.

10. The steam turbine as claimed in claim 6, wherein between the inner casing and the thrust-compensating partition wall a first brush seal is arranged upstream of the second thrust-compensating partition wall space along the second flow direction and a second brush seal is arranged downstream of the first thrust-compensating partition wall space along the second flow direction.

11. The steam turbine as claimed in claim 6, wherein the first cross feedback passage is formed by pipes.

12. The steam turbine as claimed in claim 6, wherein the connection is formed by connecting pipes.

13. The steam turbine as claimed in claim 6, wherein the third high-pressure blading stage is arranged downstream of the second high-pressure blading stage as seen in the first flow direction.

14. A method for cooling a steam turbine, wherein the steam turbine has a high-pressure region and an intermediate-pressure region, wherein a rotor has a thrust-compensating partition wall between the high-pressure region and the intermediate-pressure region, the method comprising:

extracting steam from the high-pressure region and feeding to a space between the thrust-compensating partition wall and inner casing, feeding steam from the space between the thrust-compensating partition wall and the inner casing via a first cross feedback passage to the high-pressure region, further comprising:

between thrust-compensating partition wall and inner casing, feeding additional steam via a second cross feedback passage into the high-pressure region.

* * * * *